US008909100B2

(12) United States Patent
Takahashi et al.

(10) Patent No.: US 8,909,100 B2
(45) Date of Patent: Dec. 9, 2014

(54) ELECTROPHOTOGRAPHIC PHOTORECEPTOR, PROCESS CARTRIDGE AND ELECTROPHOTOGRAPHIC PHOTORECEPTOR MANUFACTURING METHOD

(71) Applicant: Fuji Electric Co., Ltd., Kawasaki (JP)

(72) Inventors: Yuki Takahashi, Matsumoto (JP); Yasushi Tanaka, Matsumoto (JP)

(73) Assignee: Fuji Electric Co., Ltd., Kawasaki-shi (JP)

( * ) Notice: Subject to any disclaimer, the term of this patent is extended or adjusted under 35 U.S.C. 154(b) by 67 days.

(21) Appl. No.: 13/674,347

(22) Filed: Nov. 12, 2012

(65) Prior Publication Data

US 2013/0170856 A1 Jul. 4, 2013

(30) Foreign Application Priority Data

Dec. 28, 2011 (JP) ..... 2011-288842

(51) Int. Cl.
*G03G 15/00* (2006.01)

(52) U.S. Cl.
CPC ..... *G03G 15/751* (2013.01)
USPC ..... 399/159

(58) Field of Classification Search
CPC ..... G03G 15/75; G03G 15/751
USPC ..... 399/116, 159
See application file for complete search history.

(56) References Cited

U.S. PATENT DOCUMENTS

| | | | | |
|---|---|---|---|---|
| 4,617,245 | A * | 10/1986 | Tanaka et al. | 430/59.1 |
| 5,561,021 | A * | 10/1996 | Yamazaki et al. | 430/130 |
| 6,453,137 | B2 * | 9/2002 | Iinuma | 399/159 |
| 7,266,329 | B2 * | 9/2007 | Matsuo et al. | 399/159 |
| 2005/0255393 | A1 | 11/2005 | Nakata et al. | |
| 2007/0264049 | A1 * | 11/2007 | Kamoshida et al. | 399/168 |

FOREIGN PATENT DOCUMENTS

| | | | |
|---|---|---|---|
| JP | S57-094772 | A | 6/1982 |
| JP | H02-139566 | A | 5/1990 |
| JP | H04-281461 | A | 10/1992 |
| JP | H06-282089 | A | 10/1994 |
| JP | H08-123058 | A | 5/1996 |
| JP | 2000-227671 | A | 8/2000 |
| JP | 2001-066814 | A | 3/2001 |
| WO | 2005/093518 | A1 | 10/2005 |

* cited by examiner

*Primary Examiner* — Gregory H Curran

(74) *Attorney, Agent, or Firm* — Rabin & Berdo, P.C.

(57) ABSTRACT

An electrophotographic photoreceptor apparatus is provided and a method of manufacturing such a photoreceptor. The electrophotographic photoreceptor includes a cylindrical substrate. A photosensitive layer is formed on the cylindrical substrate. The photoreceptor has first surface corrugations with a pitch of 0.4 to 0.6 mm in an axial direction of the photoreceptor. Each of the first surface corrugations has a depth of 3.0 to 5.0 μm.

13 Claims, 5 Drawing Sheets

ELECTROPHOTOGRAPHIC PHOTORECEPTOR, PROCESS CARTRIDGE AND ELECTROPHOTOGRAPHIC PHOTORECEPTOR MANUFACTURING METHOD

CROSS-REFERENCE TO RELATED APPLICATION

This application is based on, and claims priority to, Japanese Patent Application No. 2011-288842, filed on Dec. 28, 2011, contents of which are incorporated herein by reference.

BACKGROUND OF THE INVENTION

1. Field of the Invention

The present invention relates to an electrophotographic photoreceptor, a process cartridge and an electrophotographic photoreceptor manufacturing method (hereunder sometimes called simply a "photoreceptor" and a "manufacturing method"), and specifically relates to an electrophotographic photoreceptor and a process cartridge for use in various kinds of electrophotographic devices such as copiers and printers, and also relates to a method for manufacturing an electrophotographic photoreceptor.

2. Description of the Related Art

In recent years, organic electrophotographic photoreceptors (organic photoreceptors) provided with a functional layer of an organic material on a support have come to predominate as electrophotographic photoreceptors. This is because of the diversity of material design for organic semiconductors, which has led to the development of superior charge generating materials, charge transport materials and binder resins, and allowed the production of low-cost, high performance commercial photoreceptor products. These organic photoreceptors can be classified generally into functionally separated semiconductors comprising a charge generating layer stacked with a charge transport layer, and monolayer photoreceptors comprising a charge generating material and a charge transport material dispersed in a single layer.

Electrophotographic photoreceptors are subjected to repeated cycles of charging, exposure, development, transfer, cleaning and charge neutralization during the image forming process. This image forming process comprises a sequence of processes, specifically charging the surface of the photoreceptor, forming an electrostatic latent image by light exposure on the surface of the photoreceptor, developing this electrostatic latent image with toner, transferring the formed toner image to a transfer medium, removing the residual toner on the photoreceptor surface with a cleaning blade, and neutralizing the charge on the photoreceptor surface.

The cleaning step of removing residual toner from the photoreceptor surface after the transfer step is particularly important for obtaining a clear image. One cleaning method used in this process is a method of scraping off the residual toner by pressing an elastic cleaning blade against the photoreceptor surface. However, the problem has been that because there is normally a large frictional force operating between the elastic blade and the photoreceptor surface, the elastic blade is liable to curl back, particularly at the beginning of use when the photoreceptor and elastic blade have not become adjusted to each other.

Conventionally, one method that has been proposed for solving this problem is to roughen the photoreceptor surface to a suitable degree to reduce the contact area between the photoreceptor surface and the elastic blade and thereby reduce the frictional force. Because the problem of friction between the elastic blade and the photoreceptor is normally greater the higher the mechanical strength of the photoreceptor surface and more resistant the outside of the photoreceptor is to wear, roughening the photoreceptor surface is an extremely effective way of alleviating the problems that occur when the photoreceptor surface is strengthened by improving the resin making up the surface layer of the photoreceptor.

Specific methods of roughening the photoreceptor surface include the following. For example, JP-A-H4-281461 (Claims, etc.) discloses a technique using a layer of metal or metal oxide fine powder dispersed in a binder resin as a surface protective layer of an electrophotographic photoreceptor. JP-A-S57-094772 (Claims, etc.) discloses a method for polishing the surface of an organic electrophotographic photoreceptor, in which the photoreceptor surface is polished with a specific metal wire or fiber brush to thereby form fine projections and indentations on the surface of the photoreceptor. JP-A-H2-139566 (Claims, etc.) discloses a technique for roughening the surface of an organic electrophotographic photoreceptor by using a film abrasive to grind the photoreceptor in at least two directions at different angles to the direction of a generatrix.

These conventional techniques are thought to be somewhat effective because they roughen the photoreceptor surface to a certain degree. However, techniques have yet to be established for fabricating the surface form of the photoreceptor with finer and more precise control in order to improve the performance and productivity of the photoreceptor.

There have also been proposals for more detailed analysis and research focused on controlling the surface forms of photoreceptors, and for example WO 2005/093518 (Claims, etc.) proposes an electrophotographic photoreceptor provided on the circumference with multiple dimple-shaped recesses so as to resolve problems with the cleaning properties, rubbing memory and the like. However, with this technique it is thought that improvements in durability will be required to extend the life of the photoreceptor.

JP-A-2001-066814 (Claims, etc.) discloses a technique for forming specific projections and indentations on the outermost surface of an electrophotographic photoreceptor by using a touch roll with surface projections and indentations to mold the outermost surface of the photoreceptor. With this technique, however, it is thought that the initially formed projections and indentations will not be maintained over use because the surface layer of the photoreceptor is composed of a thermoplastic resin.

Furthermore, JP-A-H6-282089 (Claims, etc.) discloses a photoreceptor comprising grooves of a specific width and depth in parallel in the circumferential direction on the surface of a cylindrical base body, wherein the cross-section of each groove has a regular shape in the direction of width, thereby regularly changing the film thickness of a coating layer. JP-A-2000-227671 (Claims, etc.) discloses an organic photoreceptor comprising surface roughness waveforms formed regularly on the surface of a substrate, and having fine projections and indentations of a specific height within each waveform of these regular surface roughness waveforms. JP-A-H8-123058 (Claims, etc.) discloses an electrophotographic photoreceptor comprising a conductive substrate having a surface shape in which the ratio of the height of the peaks to the depth of the valleys in a ruggedness pattern obtained from its filtering waviness curve is greater than or equal to a specific value, and the distance between adjacent peaks and the difference in level between adjacent peaks and valleys are within specific ranges.

As discussed above, there have been a variety of proposals for improving the surface shapes of photoreceptors in order to prevent blade curling, but these conventional techniques have all been unsatisfactory in terms of production cost because they require post-processing after formation of the photoreceptor or the introduction of specialized equipment.

SUMMARY OF THE INVENTION

It is therefore an object of the present invention to resolve these problems and, to provide a technique for improving the surface shape of the photoreceptor so as to easily and cheaply prevent the occurrence of elastic blade curling, which is a serious problem that occurs in image forming processes.

The inventors in this case perfected the present invention as a result of exhaustive research after discovering that this problem could be resolved by providing specific corrugations on the surface of the photoreceptor.

That is, the present invention features an electrophotographic photoreceptor comprising at least a photosensitive layer on a cylindrical substrate, and having surface corrugations with a pitch (L) of 0.4 to 0.6 mm in an axial direction of the photoreceptor and the surface corrugations have a depth (d) of 3.0 to 5.0 μm.

In the photoreceptor of the present invention, the cylindrical substrate preferably has surface corrugations with a pitch ($L_0$) of 0.4 to 0.6 mm in the axial direction of the photoreceptor and a depth ($d_0$) of 3.2 to 5.2 μm. Moreover, the photoreceptor of the present invention is applied to an image forming apparatus using an elastic blade in a cleaning process, and can be made so that it causes no curling of the elastic blade when the photoreceptor is in sliding contact with a surface of the elastic blade. In addition, in the photoreceptor of the present invention, the photosensitive layer can be formed by dip coating a photosensitive layer-forming coating liquid on the aforementioned cylindrical substrate having surface corrugations, at a lifting speed of the cylindrical substrate in a range of 2 to 3 mm/s.

The process cartridge of the present invention features the use of the aforementioned electrophotographic photoreceptor of the present invention as the electrophotographic photoreceptor in a process cartridge provided with an electrophotographic photoreceptor having at least a photosensitive layer on a cylindrical substrate, and an elastic blade that removes residual toner from a surface of the electrophotographic photoreceptor after a toner image formed on the surface of the electrophotographic photoreceptor has been transferred to a transfer medium.

Moreover, the electrophotographic photoreceptor manufacturing method of the present invention is an electrophotographic photoreceptor manufacturing method comprising a photosensitive layer forming step of forming a photosensitive layer by dip coating a photosensitive layer-forming coating liquid on a cylindrical substrate, wherein a substrate having surface corrugations with a pitch ($L_0$) of 0.4 to 0.6 mm in an axial direction of the photoreceptor and a depth ($d_0$) of 3.2 to 5.2 μm is used as the cylindrical substrate, and a lifting speed of the cylindrical substrate during the step of dip coating the photosensitive layer-forming coating liquid is in a range of 2 to 3 mm/s.

An electrophotographic photoreceptor having surface corrugations with a pitch (L) of 0.4 to 0.6 mm in the axial direction of the photoreceptor and a depth (d) of 3.0 to 5.0 μm can be obtained by the manufacturing method of the present invention.

With the configuration described above, the present invention provides an electrophotographic photoreceptor, process cartridge and electrophotographic receptor manufacturing method whereby it is possible to easily and cheaply prevent the occurrence of elastic blade curling, a serious problem that occurs in image forming processes, and especially elastic blade curling that occurs at the beginning of use.

BRIEF DESCRIPTION OF THE DRAWINGS

FIG. 3A is an explanatory drawing showing sliding contact between a conventional photoreceptor and an elastic blade, while

DESCRIPTION OF THE PREFERRED EMBODIMENTS

Embodiments of the present invention are explained in detail below with reference to the drawings.

Figure 1:
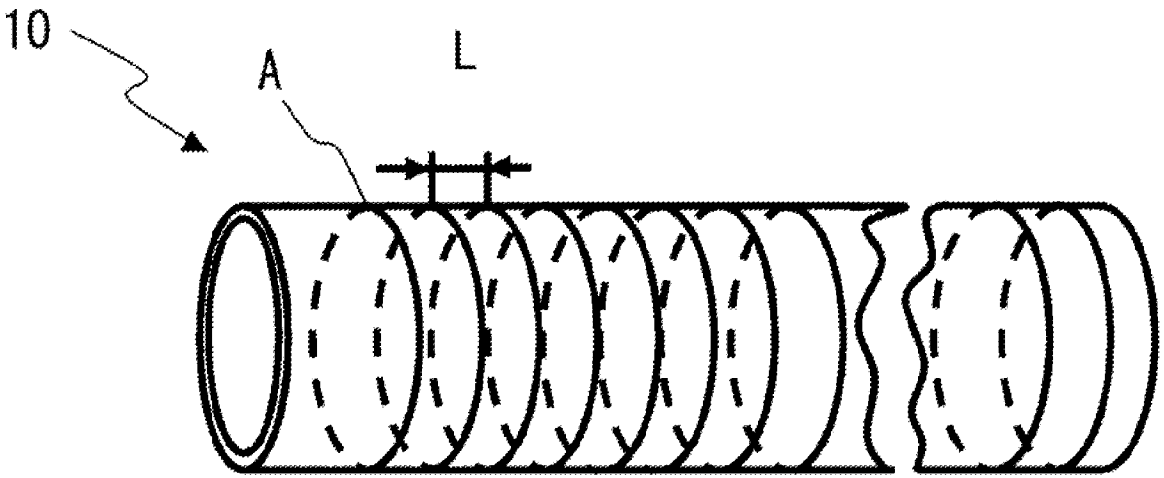
FIG. 1 is an explanatory drawing showing one example of an electrophotographic photoreceptor of the present invention.

FIG. 1 is an explanatory drawing showing one example of an electrophotographic photoreceptor of the present invention.

Figure 2:
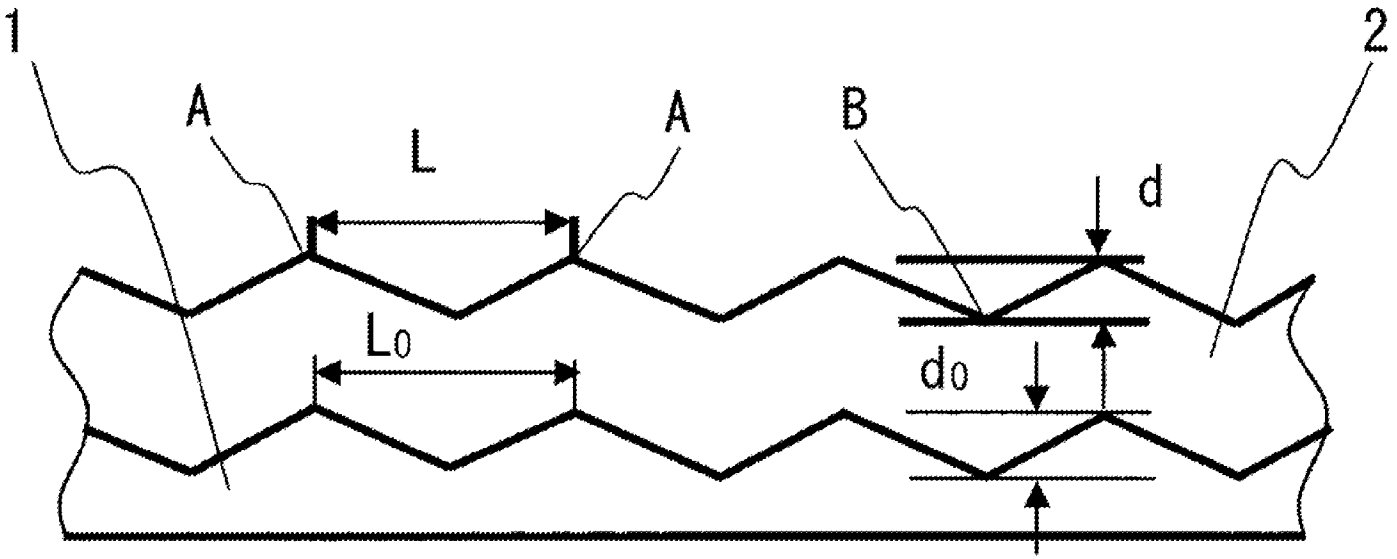
FIG. 2 is an enlarged partial axial cross-section showing one example of an electrophotographic photoreceptor of the present invention.

FIG. 2 is an enlarged partial axial cross-section showing one example of an electrophotographic photoreceptor of the present invention. As shown in the drawings, the electrophotographic photoreceptor 10 of the present invention comprises at least a photosensitive layer 2 on a cylindrical substrate 1.

The photoreceptor 10 of the present invention features surface corrugations with a pitch (L) of 0.4 to 0.6 mm in the axial direction of the photoreceptor and a depth (d) of 3.0 to 5.0 μm. That is, multiple indentations or in other words grooves extending around the circumference are formed with this pitch in the axial direction of the photoreceptor and with this depth on the surface of the photoreceptor 10 of the present invention. By providing specific corrugations on the photoreceptor surface, it is possible to reduce the contact surface between the photoreceptor surface and the elastic blade and thereby reduce the frictional force between the two when the photoreceptor of the present invention is applied to an image forming apparatus using an elastic blade in a cleaning process. Thus, with the photoreceptor of the present invention it is possible to prevent curling of an elastic blade during sliding contact with the surface of the elastic blade. Blade curling here means that when good contact between the photoreceptor and the elastic blade is broken, the frictional force between the blade and the photoreceptor increases, and the elastic blade is pulled in the direction of movement of the photoreceptor, curling back the edge of the blade tip.

As shown in the drawings, pitch (L) in the present invention is the distance between peak A and peak A of the photoreceptor corrugations in the axial direction of the photoreceptor, while depth (d) is the distance between peak A and valley B of the corrugations in the radial direction of the photoreceptor. If pitch (L) is smaller than the aforementioned range, the contact area between the elastic blade and the photoreceptor is increased, causing noise and curling, while if it is larger, the contact area is also increased because the peaks of the corrugation acquire curvature instead of being saw teeth, and in both cases the desired effects of the present invention are not obtained. If depth (d) is shallower than the aforementioned range, meanwhile, the contact area between the elastic blade and the photoreceptor is increased, while if it is deeper the risk of toner slippage is increased, and in both cases the desired effects of the present invention are not obtained.

Figure 3A:
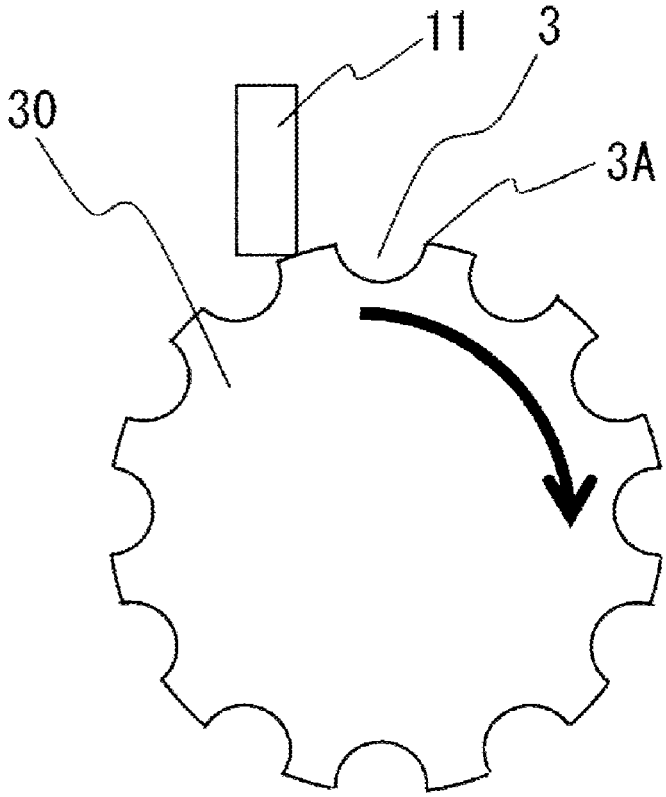
Figure 3B:
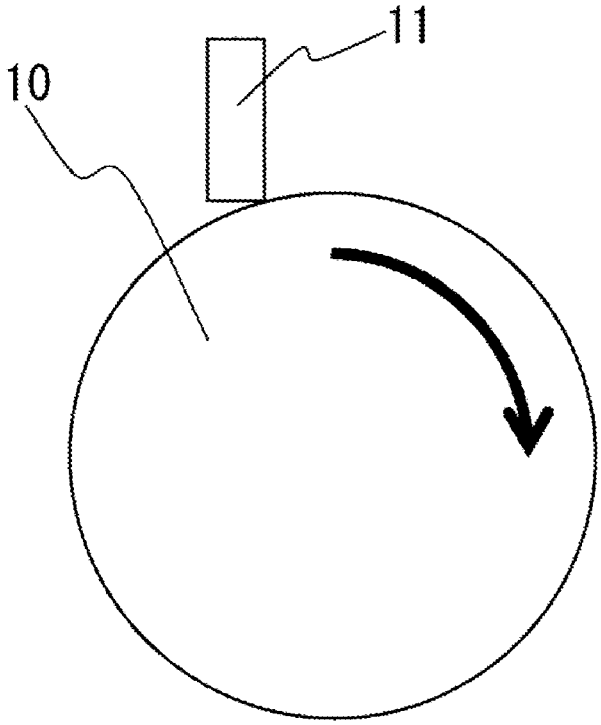
FIG. 3B is an explanatory drawing showing sliding contact between the photoreceptor of the present invention and an elastic blade.

As shown in FIG. 3A, in a conventional photoreceptor 30 having dimple-shaped projections and indentations on the surface there is a risk of curling due to contact between the tip of cleaning blade 11 and edge 3A of indentation 3 of the projections and indentations, but because photoreceptor 10 of the present invention only has corrugations in the axial direction with no projections in the circumferential direction, there is little resistance to cleaning blade 11 during sliding contact as shown in FIG. 3B, which is effective for preventing curling of the cleaning blade. Moreover, because the corrugated shape of the surface of the photoreceptor of the present invention offers little resistance to cleaning blade 11 during sliding contact, there is little risk that the initial shape will be lost during use, and durability is therefore excellent. As discussed below, moreover, this photoreceptor of the present invention is also advantageous in terms of production costs because no post-processing step or specialized equipment is required after photoreceptor formation as it is with conventional technology.

In the present invention, it is sufficient that the corrugations on the photoreceptor surface meet the conditions of having a pitch (L) of 0.4 to 0.6 mm and a depth (d) of 3.0 to 5.0 μm. Specifically, the cross-section of the corrugations may have a zigzag shape composed of straight lines as shown in the drawings for example, or the cross-section of the corrugations may have a sine or cosine wave shape composed of curved lines (not shown).

Moreover, as shown in FIG. 2, cylindrical substrate 1 in the present invention is preferably one having surface corrugations with a pitch ($L_0$) of 0.4 to 0.6 mm in the axial direction of the photoreceptor and a depth ($d_0$) of 3.2 to 5.2 μm. That is, using a cylindrical substrate 1 having surface corrugations and coating a photosensitive layer-forming coating liquid on this cylindrical substrate 1 so as to conform with its surface shape is desirable because it allows the easy formation of a photoreceptor having specific surface corrugations. The pitch ($L_0$) and depth ($d_0$) of the corrugations formed on the surface of cylindrical substrate 1 and the corrugations themselves are defined in the same way as the pitch (L), depth (d) and corrugations on the photoreceptor surface as described above. The difference of 0.2 μm between the depth of the corrugations on the surface of cylindrical substrate 1 and the depth of the corrugations on the surface of the photoreceptor is explained by the fact that coating the photosensitive layer on cylindrical substrate 1 reduces the depth by 0.2 μm.

The photoreceptor of the present invention is not particularly limited as long as it has the aforementioned specific corrugations on its surface, and may be configured appropriately according to ordinary methods. For example, cylindrical substrate 1 may function simultaneously as an electrode of the photoreceptor and as a support for the various layers making up the photoreceptor, and it may be made of aluminum, stainless steel, nickel or another metal, or of glass or resin which has been given a surface conductive treatment or the like.

Photosensitive layer 2 comprises principally a binder resin, a charge-generating material, and a hole transport material and electron transport material as charge transport materials, along with various additives as necessary, and a monolayer photosensitive layer comprising all these materials dispersed in a single layer is used in the present invention.

The binder resin is not particularly limited, and resins normally used for forming photosensitive layers may be used appropriately, including for example polycarbonate resin, polyallylate resin, polyphenylene resin, polyester resin, polyvinyl acetal resin, polyvinyl butyral resin, polyvinyl alcohol resin, vinyl chloride resin, vinyl acetate resin, polyethylene resin, polypropylene resin, acrylic resin, polyurethane resin, epoxy resin, melamine resin, silicone resin, polyamide resin, polystyrene resin, polyacetal resin, polysulfone resin, polymers of methacrylic acid esters and copolymers of these and the like. In the present invention, a polycarbonate resin with a weight-average molecular weight of 10,000 to 100,000 or especially 20,000 to 50,000 can be used by preference as the binder resin. Specific examples of this polycarbonate resin include bisphenol A, bisphenol Z, bisphenol A-biphenyl copolymer, bisphenol Z-biphenyl copolymer, bisphenol ZC, bisphenol C and other polycarbonate resins. A combination of different kinds of resin may also be used, especially a mixture of two or more kinds of polycarbonate resin, and a mixture of resins of the same kind with different molecular weights may also be used. The content of the binder resin may be 40 mass % to 60 mass % of the solids in the photosensitive layer.

The charge generating material is not particularly limited, and for example a phthalocyanine pigment, azo pigment, anthanthrone pigment, perylene pigment, perinone pigment, polycyclic quinone pigment, squarilium pigment, thiapyrilium pigment, quinacridone pigment or the like may be used. Of these, it is desirable to use a phthalocyanine pigment. Metal-free phthalocyanine, copper phthalocyanine and titanyl phthalocyanine are preferred as this phthalocyanine pigment. The content of the charge generating material may be 0.7 mass % to 2 mass % of the solids in the photosensitive layer.

Phthalocyanine pigments exist in a variety of crystalline forms, and examples include X-type metal-free phthalocyanine, τ-type metal-free phthalocyanine, ϵ-type copper phthalocyanine, α-type titanyl phthalocyanine, β-type titanyl phthalocyanine, Y-type titanyl phthalocyanine, amorphous titanyl phthalocyanine, and the titanyl phthalocyanine described in JP-A-H8-209023, which has a maximum peak at a Bragg angle 2θ of 9.6° in the CuKα: X-ray diffraction spectrum. Of these, the X-type metal-free phthalocyanine described in JP-A-2001-228637, α-type titanyl phthalocyanine, Y-type titanyl phthalocyanine and the titanyl phthalocyanine described in JP-A-2001-330972 are particularly desirable for example.

The hole transport material is not particularly limited, and specifically styryl compounds, hydrazone compounds, pyrazoline compounds, pyrazolone compounds, oxadiazole compounds, oxazole compound, arylamine compounds, benzidine compounds, stilbene compounds, polyvinyl carbazole, polysilane and the like may be used for example, but of these a styryl compound is preferred. One of these hole transport materials may be used alone, or two or more may be combined appropriately. The content of the hole transport material may be 20 mass % to 40 mass % of the solids in the photosensitive layer.

The electron transport material is not particularly limited, and specifically succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranyl, bromanyl, o-nitrobenzoic acid, trinitrofluorenone, quinone, benzoquinone, diphenoquinone, naphthoquinone, anthraquinone, stilbenequinone and other electron receivers and electron transporters may be used for example. One such electron receiver or electron transporter may be used, or a combination of two or more may be used. The content of the electron transport material is 10 mass % to 25 mass % of the solids in the photosensitive layer.

An antioxidant, light stabilizer or other deterioration preventer may be included in the photosensitive layer with the aim of improving environmental resistance and stability with respect to harmful light. Examples of compounds that can be used for such purposes include tocopherols and other chromanol derivatives and esterified compounds, polyarylalkane compounds, hydroquinone derivatives, etherified compounds, dietherified compounds, benzophenone derivatives, benzotriazole derivatives, thioether compounds, phenylenediamine derivatives, phosphonic acid esters, phosphite esters, phenol compounds, hindered phenol compounds, linear amine compounds, cyclic amine compounds, hindered amine compounds and the like. A leveling agent such as silicone oil or fluorine oil may also be included in the photosensitive layer in order to impart lubricity and improve the leveling properties of the formed film.

A metal oxide such as silicon oxide (silica), titanium oxide, zinc oxide, calcium oxide, aluminum oxide (alumina) or zirconium oxide, a sulfate salt such as barium sulfate or calcium sulfate, fine particles of a metal nitride such as silicon nitride or aluminum nitride, ethylene tetrafluoride resin or other fluorine resin particles or silicone resin fine particles, or a fluorine comb-shaped graft polymer resin or other fluorine-containing polymer or silicon-containing polymer or the like may also be included in the photosensitive layer with the aim of conferring lubricity, reducing the friction coefficient and the like.

The film thickness of the photosensitive layer is preferably in the range of 3 to 100 μm or more preferably 10 to 50 μm in order to maintain an effective surface potential for actual use.

As discussed above, the photoreceptor of the present invention can be manufactured by coating a photosensitive layer-forming coating liquid on the cylindrical substrate 1, which has specific corrugations on its surface. Specifically, the photosensitive layer is formed by dip coating a photosensitive layer-forming coating liquid on this cylindrical substrate 1 at a lifting speed of 2 to 3 mm/s of the cylindrical substrate. When the cylindrical substrate is immersed in the photosensitive layer-forming coating liquid and then lifted out during the dip coating process, a coated film of the photosensitive layer-forming coating liquid forms on the surface of the cylindrical substrate, and when the lifting speed is within the aforementioned range, it is possible to form a photosensitive layer film that conforms to the surface shape of the cylindrical substrate, and obtain a photoreceptor having a surface with the aforementioned corrugations of the present invention. If the lifting speed is too slow the film thickness is thin, while if it is too fast the film thickness is too thick, and in both cases a photoreceptor having the specified corrugated surface of the present invention is not obtained.

The viscosity of the photosensitive layer-forming coating liquid used in the present invention is preferably 400 to 500 cP during dip coating. If the viscosity of the coating liquid is too low, it is possible to adjust the film thickness by increasing the lifting speed, but in this case the liquid is likely to drip immediately after coating, making it difficult to obtain corrugations on the photoreceptor surface that conform to the corrugations on the cylindrical substrate. If the viscosity of the coating liquid is too high, on the other hand, it becomes necessary to lower the lifting speed, greatly detracting from productivity. Thus, the viscosity of the coating liquid is preferably within a range that allows the lifting speed to be adjusted within the range of 2 to 3 mm/s. The viscosity of the photosensitive layer-forming coating liquid can be controlled by appropriately adjusting the compounded contents.

Figure 4:
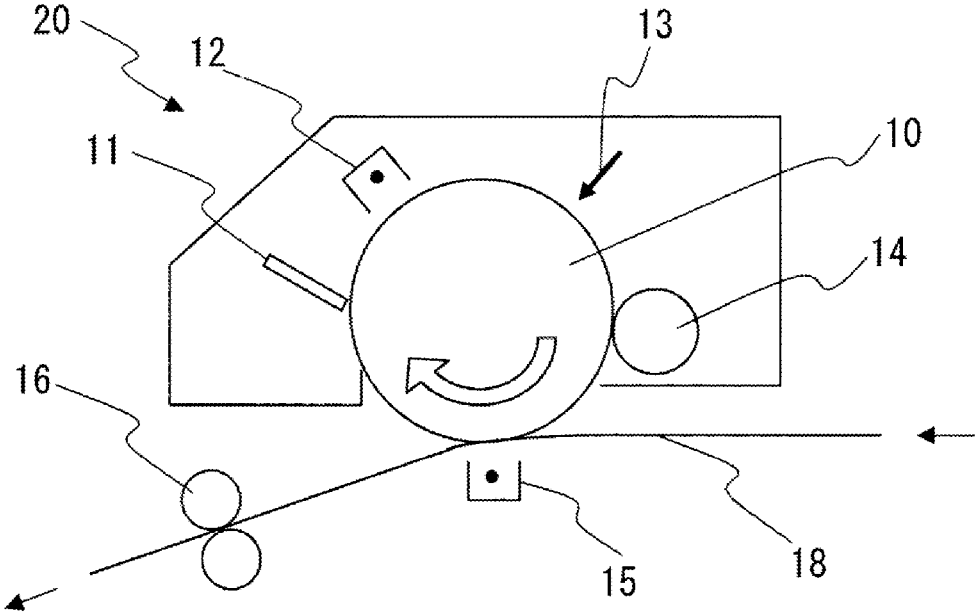
FIG. 4 is an explanatory drawing showing one example of a process cartridge of the present invention.

FIG. 4 is an explanatory drawing showing one example of a process cartridge of the present invention. The process cartridge 20 of the present invention show here is provided with a photoreceptor 10 comprising at least a photosensitive layer on a cylindrical substrate, and an elastic blade 11 for removing residual toner from the surface of the photoreceptor 10 after a toner image formed on the surface of the photoreceptor has been transferred to a transfer medium. The process cartridge is designed to be attached to and removed from the body of the apparatus by the user.

It is a feature of the process cartridge of the present invention that the photoreceptor of the present invention is used as the photoreceptor 10. As discussed above, by incorporating the photoreceptor of the present invention into a process cartridge in this way it is possible to effectively control curling of the elastic blade during sliding contact between the photoreceptor 10 and the elastic blade 11, especially at the beginning of use.

The process cartridge of the present invention is not particularly limited as long as it is equipped with the aforementioned photoreceptor of the present invention, and may be configured appropriately by ordinary methods. For example, in the process cartridge 20 shown in the drawing, a scorotron is provided as a charging mechanism 12 on the outer circumference of the photoreceptor 10 in addition to the photoreceptor 10 and elastic blade 11 as the cleaning mechanism, and the charge generated by corona discharge is released from an opening in the casing, thereby charging the photoreceptor. The charged photoreceptor 10 is then exposed to light by exposure means 13 in accordance with image data. The charge potential is attenuated in the part exposed to light, forming a two-dimensional electrostatic latent image. Next, a developing means 14 supplies a developer to the electrostatic latent image on the surface of the photoreceptor 10, and an image is formed by the developer on the surface of the photoreceptor 10. The developer image formed on the surface of the photoreceptor 10 is transferred by a transfer means 15 onto a transfer medium 17. The transfer medium 17 is one on which an image is formed by the developer, and may be printing paper or a label or the like for example. The developer image transferred to the transfer medium 17 is melted by a fuser roller 16 and then pressed to fix it on transfer medium 17, thereby forming an image. Meanwhile, the elastic blade 11 is disposed as a cleaning means in contact with the outer circumference of the photoreceptor 10, and the tip of the elastic blade 11 is in elastic contact with the photoreceptor 10. This elastic blade 11 removes developer remaining on the photoreceptor 10 after the developer image has been transferred to the transfer medium 17. Developer that has been removed from the surface of the photoreceptor 10 by the elastic blade 11 is contained in a removed developer container (not shown).

In the elastic blade 11 used in the process cartridge of the present invention, the surface in contact with the photoreceptor 10 may be formed of any elastic material, such as normally a thermosetting polyurethane rubber or other rubber material or the like, without any particular limitations. This thermosetting polyurethane rubber is synthesized for example via a polyaddition reaction using as the basic raw materials a long-chain active hydrogen compound (long chain polyol) making up the soft segments, a polyisocyanate for the hard segments, and a short-chain active hydrogen compound for reacting with the isocyanate to create hard segments and crosslinking points, with various auxiliary materials added to improving workability and performance. In addition to the charging means 12, the exposure means 13 and the developing means 14 in the process cartridge of the present invention, the transfer means 15 and fuser roller 16 used in the image forming process can be selected and used appropriately from ordinary means, without any particular limitations.

EXAMPLES

The present invention is explained in detail below by means of specific examples.

<Preparation of Photoreceptor>

The outer surface of an aluminum tube used as a cylindrical substrate with a length of 260 mm and a diameter of 30 mm was worked with a cutting lathe to form specific corrugations on the surface in accordance with the conditions shown in the following tables. The depth of the corrugations was adjusted by adjusting the angle of the tool bit and the amount of embedding. The pitch of the corrugations was adjusted by altering the speed of movement of the tool bit in the axial direction of the photoreceptor.

Each of the resulting aluminum tubes was ultrasound washed in a 45° degreasing tank containing a detergent (Elise™). Next, detergent (Castrol™) was sprayed on the surface of each aluminum tube, which was then brushed and rinsed with pure warm water, and the moisture was removing in a drying oven.

Next, using the compounded materials shown below, a polycarbonate resin was dissolved as a binder resin in a solvent, and a charge generating material, hole transport material and electron transport material were further dispersed to prepare a photosensitive layer-forming coating liquid. The concentrations of the compounded materials are shown as percentages of the coating liquid.

| | |
|---|---|
| (Solvent): Tetrahydrofuran | 75 mass % |
| (Binder resin): Bisphenol Z polycarbonate resin having repeating units shown by Formula (1) below (molecular weight 50,000; Mitsubishi Gas Chemical Company, Inc., Iupizeta PCZ-500) | 11.5 mass % |
| (Charge generating material): X-type metal-free phthalocyanine | 0.5 mass % |
| (Hole transport material): Styryl compound represented by Formula (2) below | 9 mass % |
| (Electron transport material): Azoquinone compound represented by Formula (3) below | 4 mass % |

Formula (1)

(1)

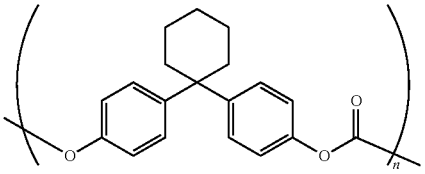

Formula (2)

(2)

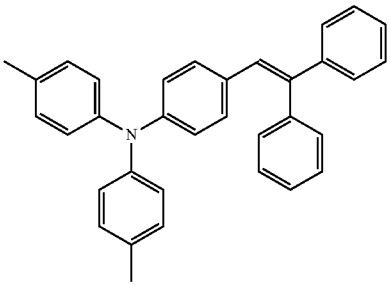

-continued

Formula (3)

(3)

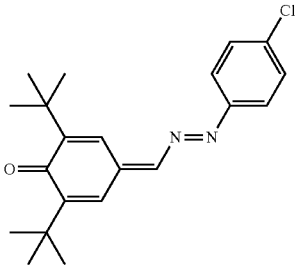

Each of the aluminum tubes described above was dipped in the coating liquid, and then lifted to coat a film of the coating liquid on the surface of the aluminum tube, which was then heated and dried at 100° C. for 60 minutes to remove the solvent and form a photosensitive layer with a dried film thickness of 20 μm. The temperature of the coating liquid during the dip coating step was 22° C., and the viscosity was 450 cP. The lifting speed of each aluminum tube was 2.2 mm/s.

The pitch (L) in the axial direction and the depth (d) of the corrugations on the surface of the resulting photoreceptors were evaluated with a surface roughness gauge (Accretech, Surfcom 1400D). The results are shown together in the table below. There was no difference in the pitch of the corrugations before and after formation of the photosensitive layer, but the depth was reduced by 0.2 mm from the depth on the substrate.

<Evaluation Methods>

Curling of the elastic blade during use and the occurrence of image defects were evaluated for each of the resulting photoreceptors. Specifically, each photoreceptor was installed in a commercial laser printer (printing device), and an endurance image output evaluation was performed under high-temperature, high-humidity conditions of 32° C., 80% RH. Letter paper (vertical) was used for the evaluation, and images were output with a 4% printing ratio. The occurrence of blade curling (noise) during feed of 5000 sheets was confirmed as the evaluation item. After 5000 sheets had been fed through the printer, 10 solid black images were printed followed by three solid white images, and the occurrence of black dots and other defects in the images was evaluated visually. A laser printer having an elastic blade using thermoplastic polyurethane rubber was used.

The presence or absence of blade curling was evaluated as ○ if no noise occurred, Δ if slight noise occurred, and x if more noise occurred or if the printer stopped because due to curling of the elastic blade. The presence or absence of image defects was evaluated as ○ if there were no black dots or bars, Δ if black dots and bars were at an allowable level, and x if black dots and bars were at an unallowable level. As a general evaluation, a grade of ○ was given if both of the above items were graded ○, Δ if one was ○ and the other was Δ, or if both were Δ, and x if at least one was x.

The evaluation results are shown together in the tables below.

TABLE 1

| | Corrugation depth of cylindrical substrate surface ($d_0$) (μm) | Corrugation depth of photoreceptor surface ($d_0$) (μm) | Pitch (L), ($L_0$) (mm) | Blade curling | Image defects | General evaluation |
|---|---|---|---|---|---|---|
| CE 1 | 1.2 | 1.0 | 0.3 | x | x | x |
| CE 2 | | | 0.4 | x | x | x |
| CE 3 | | | 0.5 | x | x | x |
| CE 4 | | | 0.6 | x | x | x |
| CE 5 | | | 0.7 | x | x | x |
| CE 6 | 2.2 | 2.0 | 0.3 | x | x | x |
| CE 7 | | | 0.4 | x | Δ | x |
| CE 8 | | | 0.5 | Δ | Δ | Δ |
| CE 9 | | | 0.6 | Δ | Δ | Δ |
| CE 10 | | | 0.7 | Δ | x | x |
| CE 11 | 3.2 | 3.0 | 0.3 | Δ | ○ | Δ |
| Ex 1 | | | 0.4 | ○ | ○ | ○ |
| Ex 2 | | | 0.5 | ○ | ○ | ○ |
| Ex 3 | | | 0.6 | ○ | ○ | ○ |
| CE 12 | | | 0.7 | ○ | Δ | Δ |
| CE 13 | 4.2 | 4.0 | 0.3 | Δ | ○ | Δ |
| Ex 4 | | | 0.4 | ○ | ○ | ○ |
| Ex 5 | | | 0.5 | ○ | ○ | ○ |
| Ex 6 | | | 0.6 | ○ | ○ | ○ |
| CE 14 | | | 0.7 | ○ | Δ | Δ |

TABLE 2

| | Corrugation depth of cylindrical substrate surface ($d_0$) (μm) | Corrugation depth of photoreceptor surface ($d_0$) (μm) | Pitch (L), ($L_0$) (mm) | Blade curling | Image defects | General evaluation |
|---|---|---|---|---|---|---|
| CE 15 | 5.2 | 5.0 | 0.3 | Δ | ○ | Δ |
| Ex 7 | | | 0.4 | ○ | ○ | ○ |
| Ex 8 | | | 0.5 | ○ | ○ | ○ |
| Ex 9 | | | 0.6 | ○ | ○ | ○ |
| CE 16 | | | 0.7 | ○ | x | x |
| CE 17 | 6.2 | 6.0 | 0.3 | Δ | x | x |
| CE 18 | | | 0.4 | ○ | x | x |
| CE 19 | | | 0.5 | ○ | x | x |
| CE 20 | | | 0.6 | ○ | x | x |
| CE 21 | | | 0.7 | ○ | x | x |

As shown in the tables above, when the photoreceptor of the example had surface corrugations with a pitch (L) of 0.4 to 0.6 mm in the axial direction of the photoreceptor and a depth (d) of 3.0 to 5.0 μm, good results were obtained, with no blade curling or image defects. By contrast, when the photoreceptor of the example did not fulfill the aforementioned conditions of pitch and depth, it was not possible to avoid both blade curling and image defects.

What is claimed is:

1. An electrophotographic photoreceptor, comprising:

a cylindrical substrate; and a photosensitive layer formed on the cylindrical substrate, the photosensitive layer having a surface that includes first surface corrugations, the first surface corrugations having a pitch of 0.4 to 0.6 mm in an axial direction of the electrophotographic photoreceptor and each of the first surface corrugations having a depth of 3.0 to 5.0 μm.

2. The electrophotographic photoreceptor according to claim 1, wherein the cylindrical substrate has second surface corrugations with a pitch of 0.4 to 0.6 mm in the axial direction of the electrophotographic photoreceptor, each of the second surface corrugations having a depth of 3.2 to 5.2 μm.

3. The electrophotographic photoreceptor according to claim 2, wherein each of the first surface corrugations is formed on a straight line that extends radially outward from one of the second surface corrugations.

4. The electrophotographic photoreceptor according to claim 3, wherein each of the second surface corrugations has a depth that is 0.2 μm deeper than that of one of the first surface corrugations.

5. An image forming apparatus comprising:

an electrophotographic photoreceptor, comprising:

a cylindrical substrate; and a photosensitive layer formed on the cylindrical substrate, wherein the electrophotographic photoreceptor has first surface corrugations with a pitch of 0.4 to 0.6 mm in an axial direction of the electrophotographic photoreceptor and each of the first surface corrugations has a depth of 3.0 to 5.0 μm; and an elastic blade for cleaning the electrophotographic photoreceptor, wherein the pitch and the depths of the first surface corrugations are such that curling of the elastic blade is reduced when the electrophotographic photoreceptor is in sliding contact with a surface of the elastic blade.

6. The electrophotographic photoreceptor according to claim 1, wherein the cylindrical substrate has second surface corrugations, and wherein the photosensitive layer is formed by dip coating a photosensitive layer-forming coating liquid on the second surface corrugations with a lifting speed of the cylindrical substrate being in a range of 2 to 3 mm/s.

7. A process cartridge comprising:

the electrophotographic photoreceptor according to claim 1; and an elastic blade that removes residual toner from a cleaning surface of the electrophotographic photoreceptor after a toner image formed on the cleaning surface of the electrophotographic photoreceptor has been transferred to a transfer medium.

8. The image forming apparatus according to claim 5, wherein the cylindrical substrate has second surface corrugations with a pitch of 0.4 to 0.6 mm in the axial direction of the electrophotographic photoreceptor, each of the second surface corrugations having a depth of 3.2 to 5.2 μm.

9. An electrophotographic photoreceptor manufacturing method, comprising:

providing a cylindrical substrate; and forming a photosensitive layer on the cylindrical substrate so that the photosensitive layer has a surface that includes first surface corrugations and to thereby manufacture the electrophotographic photoreceptor, the first surface corrugations having a pitch of 0.4 to 0.6 mm in an axial direction of the electrophotographic photoreceptor and each of the first surface corrugations having a depth of 3.0 to 5.0 μm.

10. The electrophotographic photoreceptor manufacturing method according to claim 9, wherein the photosensitive layer and the cylindrical substrate form the electrophotographic photoreceptor.

11. The electrophotographic photoreceptor manufacturing method according to claim 9, wherein in the providing, the cylindrical substrate is provided to have second surface corrugations with a pitch of 0.4 to 0.6 mm in the axial direction of the electrophotographic photoreceptor, each of the second surface corrugations having a depth of 3.2 to 5.2 μm.

12. The electrophotographic photoreceptor manufacturing method according to claim 9, wherein the forming a photosensitive layer includes dip coating a photosensitive layer-forming coating liquid on the cylindrical substrate, wherein a lifting speed of the cylindrical substrate during the dip coating is in a range of 2 to 3 mm/s.

13. The electrophotographic photoreceptor manufacturing method according to claim 9, further comprising cleaning the electrophotographic photoreceptor with an elastic blade, wherein the pitch and the depths of the first surface corrugations are such that curling of the elastic blade is reduced when the electrophotographic photoreceptor is in sliding contact with a surface of the elastic blade.

* * * * *